US008727746B2

(12) United States Patent
Peia

(10) Patent No.: US 8,727,746 B2
(45) Date of Patent: May 20, 2014

(54) METHOD OF PRODUCING A MINI FAN AND A MINI FAN PRODUCED ACCORDING TO SAID METHOD

(75) Inventor: Rodica Peia, Zimmern ob Rottweil (DE)

(73) Assignee: EBM-Papst St. Georgen GmbH & Co. KG, St. Georgen (DE)

( * ) Notice: Subject to any disclaimer, the term of this patent is extended or adjusted under 35 U.S.C. 154(b) by 653 days.

(21) Appl. No.: 11/816,912

(22) PCT Filed: Dec. 10, 2005

(86) PCT No.: PCT/EP2005/013260

§ 371 (c)(1),
(2), (4) Date: Aug. 22, 2007

(87) PCT Pub. No.: WO2006/089577

PCT Pub. Date: Aug. 31, 2006

(65) Prior Publication Data

US 2009/0232677 A1 Sep. 17, 2009

(30) Foreign Application Priority Data

Feb. 24, 2005 (DE) ..... 20 2005 003 413 U

(51) Int. Cl.
*F04D 13/06* (2006.01)
*F04D 29/26* (2006.01)

(52) U.S. Cl.
USPC ..... 417/354; 310/156.26

(58) Field of Classification Search
USPC ..... 417/352, 353, 354; 264/328.8; 310/156.26
See application file for complete search history.

(56) References Cited

U.S. PATENT DOCUMENTS 4,340,261 A * 7/1982 Wehde ..... 310/90.5
4,904,175 A * 2/1990 Horibe et al. ..... 425/174.4
4,992,029 A 2/1991 Harmsen et al. ..... 417/354

(Continued)

FOREIGN PATENT DOCUMENTS

DE 296 16 169 U 11/1996
DE 198 00 570 A 7/1999

(Continued)

OTHER PUBLICATIONS

Pat. Abs. of Japan, English abstract of JP 07-203645, Itaya.

(Continued)

*Primary Examiner* — Bryan Lettman
(74) *Attorney, Agent, or Firm* — Milton Oliver, Esq.; Oliver Intellectual Property LLC

(57) ABSTRACT

A method is disclosed for producing a mini-fan that includes a fan wheel equipped with fan blades (80) and, in order to drive said fan wheel (64), an electric drive motor (61). The latter has an internal stator (90) and an external rotor (62). The latter has a supporting part (64) made of plastic and connected to a shaft (60), which part is implemented integrally with the fan blades (80). The external rotor (62) furthermore has at least one permanent magnet (72; 72') having hard ferromagnetic particles (74). The plastic supporting part (64) is connected by plastic injection molding to the shaft (60), and by two-component injection molding to a plastic in which the hard ferromagnetic particles (74) of the rotor permanent magnet (72; 72') are arranged, so that at least a portion of the transition zone (76) between the supporting part (64) and rotor permanent magnet (72; 72') is formed by a materially engaging connection. The pre-assembled external rotor (62), thus formed, is inserted into the mini-fan.

9 Claims, 2 Drawing Sheets

(56) References Cited

U.S. PATENT DOCUMENTS

| | | | | |
|---|---|---|---|---|
| 5,152,676 | A * | 10/1992 | Ohi | 417/354 |
| 5,831,359 | A | 11/1998 | Jeske | 310/68 B |
| 6,013,966 | A * | 1/2000 | Fehrenbacher et al. | 310/257 |
| 6,362,551 | B1 * | 3/2002 | Horng | 310/156.21 |
| 6,501,200 | B2 | 12/2002 | Engel | 310/68 R |
| 6,726,455 | B2 * | 4/2004 | Horng et al. | 417/14 |
| 7,186,075 | B2 | 3/2007 | Winkler | 415/119 |
| 7,364,411 | B2 | 4/2008 | Tamagawa et al. | 417/423.1 |
| 2005/0031464 | A1 * | 2/2005 | Huang | 417/352 |
| 2005/0106046 | A1 * | 5/2005 | Winkler | 417/423.3 |
| 2006/0153677 | A1 | 7/2006 | Winkler | 415/220 |

FOREIGN PATENT DOCUMENTS

| | | | | |
|---|---|---|---|---|
| DE | 199 30 912 | A | 2/2001 | |
| DE | 201 05 050 | U | 6/2001 | |
| DE | 20 2004 010 890 | | 11/2004 | |
| EP | 0 766370 | A2 | 4/1997 | |
| GB | 2 227 793 | A | 8/1990 | |
| JP | 60-191509 | | 12/1985 | |
| JP | 63-010760 | | 1/1988 | |
| JP | 07-203645 | | 8/1995 | |
| JP | 2003-348795 | | 12/2003 | |
| JP | 2004-190562 | | 7/2004 | |
| JP | 2004-332724 | | 11/2004 | |
| WO | WO 03-058 796 | | 7/2003 | |
| WO | WO03058796 | * | 7/2003 | H02K 29/08 |

OTHER PUBLICATIONS

Pat. Abs. of Japan, English abstract of JP 2003-348795, Aoi/Nidec.
Pat. Abs. of Japan, English abstract of JP 2004-190-562, Sakai et al.
Pat. Abs. of Japan, English abstract of JP 2004-332724, Tamagawa et al.

* cited by examiner

METHOD OF PRODUCING A MINI FAN AND A MINI FAN PRODUCED ACCORDING TO SAID METHOD

CROSS-REFERENCE

This application is a section 371 of PCT/EP2005/013 260, filed 10 Dec. 2005 and published 31 Aug. 2006 as WO 2006-089 577-A1, and further claims priority from German application DE 20 2005 003 413.4, filed 24 Feb. 2005, the disclosure of which is hereby incorporated by reference.

FIELD OF THE INVENTION

The invention relates to a method of producing a mini-fan, and it relates to a mini-fan that is obtainable according to said method. Such fans are also referred to as miniature or sub-miniature fans.

BACKGROUND

Sensor fans are used for air measurement, e.g. for air-conditioning systems in motor vehicles. These fans have, for example, an outside diameter of 30 mm, i.e. these are what is referred to in technical jargon as mini-fans.

Mini-fans of this kind also serve to cool processors in computers, for equipment cooling in small equipment, etc., and their dimensions are very small. For example:

fans of the ebm-papst 250 series have dimensions of 8×25×25 mm;

those of the ebm-papst 400F series have dimensions of 10×40×40 mm;

those of the ebm-papst 400 series have dimensions of 20×40×40 mm; and fans of the ebm-papst 600 series have dimensions of 25×60×60 mm.

The power consumption of such fans is 0.4-0.6 W for the 250 series, 0.7 to 0.9 W for the 400F series, and 0.9-3.4 W for the 400 and 600 series. Their weight is, for example, approximately 5 g for the 250 series, between 17 g and 27 g for the 400/400F series, and approximately 85 g for the 600 series.

In fans of this miniature size that must be very inexpensive, it is important to make the production and assembly thereof extremely simple, so that a high degree of automation becomes possible and so that uniformly high quality and low noise in such fans are obtained.

A further complicating factor with such extremely small fans is that their components, entirely analogously to those of a mechanical clock mechanism, are very delicate and therefore not very robust. The rotor shaft, for example, is often only as thick as a knitting needle and therefore can easily be bent if handled carelessly, rendering the fan unusable.

SUMMARY OF THE INVENTION

It is therefore an object of the invention to make available a novel method of producing a mini-fan, and a mini-fan according to said method.

According to the invention, this object is achieved by using two-component injection molding to first form an annular plastic supporting part, then form a plastic-matrix permanent-magnet rotor, and finally assemble the rotor into the fan motor and is achieved by a mini-fan in which a portion of a transition zone, between the permanent magnet material and the surrounding plastic supporting part, forms an engaging mechanical connection between these elements. Because the rotor is produced by two-component injection molding, it becomes very stable because the injection-embedded permanent magnet also contributes to the stability of the fan wheel, so that, surprisingly, motor operation becomes very quiet. In addition, there is no waste because of incorrect installation or undesirable noise, since with this type of production the motors are of consistent and very high quality. Miniaturization of such parts is moreover greatly facilitated by this type of production.

BRIEF FIGURE DESCRIPTION

Further details and advantageous refinements of the invention are evident from the exemplifying embodiments, in no way to be understood as a limitation of the invention, that are described below and depicted in the drawings. In the drawings.

DETAILED DESCRIPTION

Figure 1:
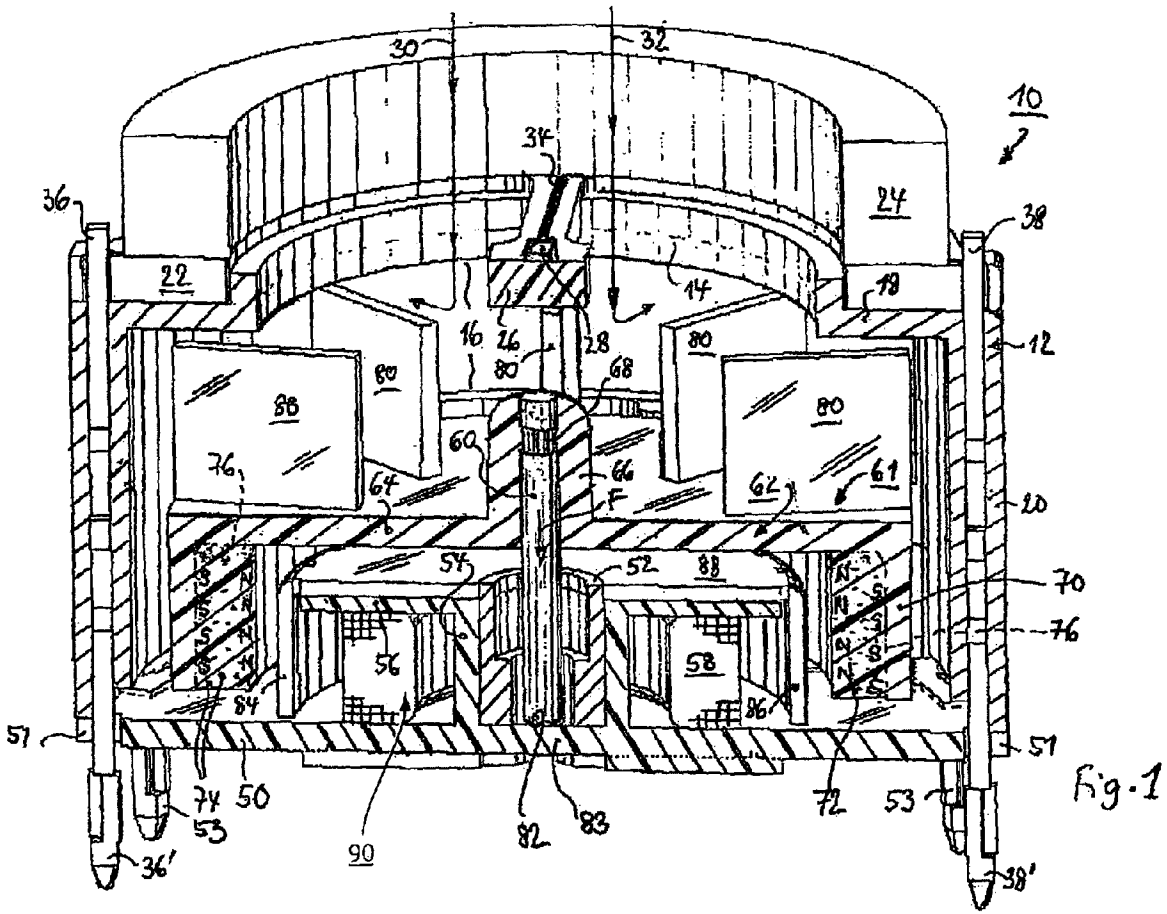
FIG. 1 is a partially sectioned three-dimensional depiction of a mini-fan according to a preferred exemplifying embodiment of the invention, shown greatly enlarged.

FIG. 1 shows a mini-fan 10 that, in practice, can usually have a diameter of 30 to 35 mm but is shown greatly enlarged for illustrative purposes. It has an external housing 12 made of an insulating plastic, and this housing has at the top an air inlet opening 14 and on the sides air outlet openings 16, of which only the rear one is visible in FIG. 1.

Proceeding from air inlet opening 14, housing 12 widens via an annular portion 18 into a cylindrical portion 20.

A circuit board 22 rests on annular portion 18, and a sealing ring 24 made of sponge rubber is mounted on that board in the manner depicted.

Circuit board 22 is substantially round and has at its center a crosspiece 26, of which only the rear half is visible in FIG. 1 and on which is arranged an NTC (Negative Temperature Coefficient) resistor 28 that serves as a temperature sensor for air that flows in from above through opening 14 in the direction of arrows 30, 32, and flows out through lateral opening 16.

Figure 3:
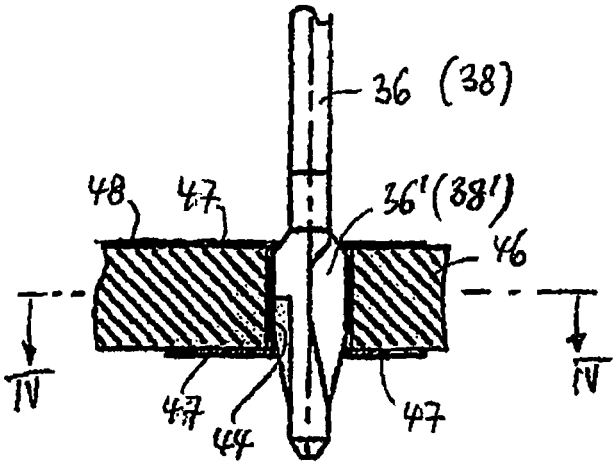
FIG. 3 depicts a contact pin with which the mini-fan can be placed onto a circuit board, this mounting part enabling both an electrical and a mechanical connection of the fan to the circuit board.
Figure 4:
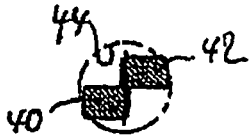
FIG. 4 is a section viewed along line IV-IV of FIG. 3.

NTC resistor 28 is connected via conductors 34 to contact pins 36, 38 that are arranged, in the manner depicted, in cylindrical part 20 of external housing 12. These contact pins 36, 38 each have at the bottom a contacting foot 36', 38', respectively, each of which has two resilient elements 40, 42 that are depicted in FIG. 4. Contacting feet 36' and 38' are inserted, according to FIGS. 3 and 4 respectively, into an opening 44 of a circuit board 46. This opening 44 is connected to a metal layer 47 that extends through opening 44 and is connected to a conductor 48 of circuit board 46. Contacting feet 36', 38' thus create electrical connections from circuit board 46 to fan 10 and its temperature sensor 28. A fan thus equipped is commonly known in the trade as a "sensor fan." Especially in the case of very small fans, it is conceivable for the electronics for commutation to be located not in fan 10 itself but rather on the relevant circuit board 46. It is also possible within the scope of the invention, however, to arrange these components in fan 10 itself.

Cylindrical part 20 of external housing 12 is closed off at the bottom by a circuit plate 50 at whose center is arranged a metal bushing 52. The latter is surrounded by a cylindrical portion 54 that is integral with circuit plate 50 and transitions at its upper end into an annular disk 56 that, together with parts 50 and 54, constitutes a coil former 57 for a stator winding 58. Circuit plate 50 has on its outer rim notches 51 through which contact pins 36 and 38, as well as other contact pins 53, project.

Located inside bushing 52 is a sintered bearing (not shown) for shaft 60 of external rotor 62 of a motor 61. Rotor 62 has a supporting part 64 made of plastic that has at its center a hub 66 into which the upper end of shaft 60 is injection-embedded, said end having a knurled portion 68 for better anchoring. External rotor 62 has approximately the shape of an upside-down bowl, and has at its periphery a rim portion 70 that extends approximately parallel to shaft 60.

As depicted, a permanent magnet 72 is directly injection-embedded into this rim portion 70 using the two-component injection method. Magnet 72 contains hard ferrites in a plastic matrix, and this plastic with its hard-ferrite particles 74 (which of course can be depicted only schematically) can therefore be injection-embedded, for example as a ring, into supporting part 64, in which context the interfaces, which are symbolized by dot-dash lines 76, are intimately joined by contact melting of the plastics. Preferably, the interfaces are so configured, e.g. by keyholing, that a mechanical engaging connection is formed.

Subsequent to the injection-embedding of ring magnet 72, the latter is radially magnetized in a suitable apparatus, as symbolically depicted in FIG. 1 in the usual way by the letters N (North pole) and S (South pole).

Radially extending fan blades 80 are implemented integrally with supporting part 64, i.e. the fan is preferably a radial one.

A great advantage of the invention is that with this type of production, external rotor 62 is already largely balanced once the plastics have been injected, so that only minor balancing work, at most, is necessary. An economy is also achieved in terms of assembly, since it is just such extremely small parts that are difficult to handle and assemble, and errors might therefore easily occur during assembly. The invention eliminates waste, since the rotor with its rotor magnet is available during assembly as a completed and tested part that simply needs to be installed in the bearing, this usually being done by inserting the shaft into the bearing.

In the fan according to FIG. 1, free end 82 of shaft 60 constitutes an axial bearing together with portion 83, located there opposite that end 82, of circuit plate 50. End 82 of shaft 60 is pressed downward against portion 83; this is achieved by the fact that ring magnet 72 is offset in an axial direction relative to cylindrical portions 84, 86 (depicted in FIG. 1) of a claw pole part 88. Ring magnet 72 is thereby pulled downward by an axial force F, as indicated by the arrow over shaft 60 in FIG. 1.

Figure 2:
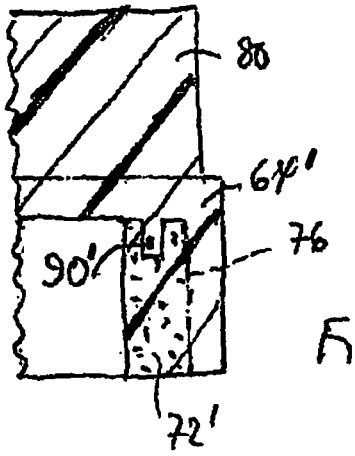
FIG. 2 is a variant of FIG. 1.

FIG. 2 shows a variant of the invention. Supporting part 64' here has an axial projection 90', and ring magnet 72', upon injection, is injected around said projection 90' so that an even more intimate connection of the plastics can occur there. Many variants are of course possible here, for example knobs, flutes, teeth, or other mechanical serration, etc., in order to optimize the connection. The variant according to FIG. 1 is preferred, however, since there the volume of ring magnet 72 is larger than in the case of FIG. 2; this improves motor output.

Many variants and modifications are of course possible, within the scope of the present invention.

What is claimed is:

1. A method of producing a mini-fan having a fan wheel equipped with fan blades (80), an electric drive motor (61) for driving said fan wheel, said drive motor (61) having an internal stator (90) and an external rotor (62), which rotor is formed with an annular supporting part (64, 64') made of plastic and connected to a shaft (60), said supporting part (64, 64') being implemented integrally with the fan blades (80) and having an axial projection (90'), and at least one annular permanent magnet (72; 72') having hard ferromagnetic particles (74), said method comprising the steps of:

forming, by two-component injection molding, first, said annular plastic supporting part (64, 64'), connected to the shaft (60), and second, said annular rotor permanent magnet (72; 72'), of ferromagnetic particles (74) embedded in a plastic matrix material, along an inner surface (70) of said annular plastic supporting part (64, 64') so that at least a portion of a transition zone (76) between the supporting part (64, 64') and rotor permanent magnet (72; 72') forms a mechanically engaging connection by contact melting together of a plastic portion of said annular supporting part and said plastic matrix material of said permanent magnet, the material forming the annular rotor permanent magnet (72, 72') being injected around said axial projection (90'); and assembling the thus-molded external rotor (62) onto said internal stator (90) to form the mini-fan.

2. The method according to claim 1, wherein said step of forming said annular plastic supporting part (64) includes simultaneously forming a plurality of fan blades (80) integrally with said supporting part (64).

3. The method according to claim 1, further comprising a step of placing the thus-molded rotor into a magnetizing apparatus to impart polarity to said embedded ferromagnetic particles (74).

4. A mini-fan, comprising a fan wheel equipped with fan blades (80), an electric drive motor (61) for driving said fan wheel, which drive motor (61) has an internal stator (90) and an external rotor (62), said external rotor including an annular plastic supporting part (64, 64') made of plastic and connected to a shaft (60), which supporting part is implemented integrally with an axial projection (90') therefrom and with said fan blades (80), which external rotor (62) has at least one permanent magnet (72; 72') having hard ferromagnetic particles (74), which particles are arranged in a matrix made of an injection-moldable plastic, and which permanent magnet (72; 72') is injection-molded as an injection-molded part onto the supporting part (64) and around said axial projection (90'), said permanent magnet (72, 72') being in contact with a radially inner surface of said axial projection and with a radially outer surface of said axial projection, at least a portion of a transition zone (76) between the supporting part and permanent magnet (72; 72') forming a mechanically engaging connection therebetween by contact melting together of a plastic portion of said annular plastic supporting part (64, 64') and plastic matrix material of said annular rotor permanent magnet (72, 72').

5. The mini-fan according to claim 4, wherein a mechanical serration (90) provides engagement between the supporting part (64) and the permanent magnet (72; 72').

6. The mini-fan according to claim 5, wherein an axial bearing (82, 83) is provided between the external rotor (62) and the internal stator (90), and the permanent magnet (72; 72') of the external rotor (62) is axially offset with respect to soft ferromagnetic parts (84, 86) of the internal stator (90) in order to produce, between the internal stator (90) and external rotor (62), a magnetic force (F) that is effective in a direction toward said axial bearing (82, 83).

7. The mini-fan according to claim 4, further comprising a temperature sensor (28) located adjacent an air outlet opening (16) formed in said mini-fan.

8. The mini-fan according to claim 7, wherein an axial bearing (82, 83) is provided between the external rotor (62) and the internal stator (90), and the permanent magnet (72; 72') of the external rotor (62) is axially offset with respect to soft ferromagnetic parts (84, 86) of the internal stator (90) in order to produce, between the internal stator (90) and external rotor (62), a magnetic force (F) that is effective in a direction toward said axial bearing (82, 83).

9. The mini-fan according to claim 4, wherein an axial bearing (82, 83) is provided between the external rotor (62) and the internal stator (90), and the permanent magnet (72; 72') of the external rotor (62) is axially offset with respect to soft ferromagnetic parts (84, 86) of the internal stator (90) in order to produce, between the internal stator (90) and external rotor (62), a magnetic force (F) that is effective in a direction toward said axial bearing (82, 83).

* * * * *